United States Patent [19]

Clarke, Jr.

[11] 4,051,563

[45] Oct. 4, 1977

[54] CUSHIONED LINER FOR A BATH TUB

[76] Inventor: Joseph A. Clarke, Jr., 75 Loomis St., Bedford, Mass. 01730

[21] Appl. No.: 577,987

[22] Filed: May 16, 1975

[51] Int. Cl.[2] ..... A47K 3/00; A47K 3/12

[52] U.S. Cl. ..... 4/173 R; 4/185 R; 4/177 CW

[58] Field of Search ..... 4/185 R, 185 F, 185 S, 4/1, 146, 173, 177, 177 IW

[56] References Cited

U.S. PATENT DOCUMENTS

| | | | |
|---|---|---|---|
| 2,264,672 | 12/1941 | Lavine | 4/185 F |
| 3,133,292 | 5/1964 | Spier | 4/185 F |
| 3,892,000 | 7/1975 | Morse | 4/185 F |
| 3,909,859 | 10/1975 | Harris | 4/185 R |

*Primary Examiner*—Henry K. Artis
*Attorney, Agent, or Firm*—Robert T. Dunn

[57] ABSTRACT

A cushioned liner that fits inside a bath tub has a back cushion provided by a flexible water bag conforming to the back of the tub and left and right side cushions provided by flexible bags conforming to the left and right sides of the tub, the bags being connected together end to end and across the bottom of the tub by a bottom portion that conforms to the tub bottom. The insides of the bags are interconnected and all are filled with water through a common filling hose after installing in the tub and before the tub is filled with water for bathing. When the tub is drained, the bags can be drained through one or more drain plugs and openings in the bottom of the liner are provided to permit draining.

13 Claims, 6 Drawing Figures

CUSHIONED LINER FOR A BATH TUB

BACKGROUND OF THE INVENTION

This invention relates to cushions for use in a bath tub and more particularly, to a removeable cushioning liner for cushioning at least the side and back walls of the bath tub to protect the bather.

Heretofore, cushions, seats and protective padding have been suggested for the use in a bath tub either to cushion the bather making him more comfortable or to protect him against injury in case he falls in the tub. Some of the cushions suggested in the past, have been made of resilient fibers encased in a waterproof covering and others have suggested using air filled cushions or mattresses which the bather blows up before filling the tub with water. The cushions of reilient fibers have not fared well because they are intrinsically stiff and heavy and so difficult to handle. Furthermore, unless the cushions of resilient fibers are tailored very particularly for the bath tub in which they are used, they will not fit the tub very well and so, will not provide the comfort and protection desired.

The air filled mattresses and bags are easily manipulated and usually of light weight and can be made to conform quite well to a wide variety of bath tub shapes and sizes. However, they float and so are very difficult to hold in place without some provisions for tying them in place. Clearly, a conventional bath tub does not provide anything to which such an air mattress or air bag can be tied to hold it in place.

In view of the general lack of success in the past providing a suitable removeably cushioning liner for a conventional bath tub, we find today very little use of liners in bath tubs except mats laid on the bottom of the tub to inhibit slipping and so, the need for a cushioning liner for a bath tub to increase both the safety and comfort of the bather remains largely unsatisfied.

SUMMARY OF THE INVENTION

In accordance with the principal feature of the present invention, a liner for a bath tub is provided with flexible water bags which are preferably formed in a plurality of compartments that can flex to conform to the walls of the tub. A hose is provided at the top of the bags for filling the bags with water from the tub spigot and a drain plug is provided at the bottom of the bag for draining them of water after use. The liner, empty of water, is very light weight and flexible and easily installed in the bath tub. As it is filled with water from the tub spigot, it becomes slightly more rigid and expands somewhat to conform more completely to the curvature of the tub walls. When the liner is filled with water, the hose is removed and capped and, then the tub is filled with water for bathing. The liner, filled with water, has a greater density than water and so, it remains firmly in place without tying or fastening to the tub even when the tub is filled with water for bathing. After the tub is emptied of bathing water, the plugs can be removed from the bottom of the liner water bags and the water can be drained from the liner, flowing out the tub drain. The liner can then be removed from the tub for storage.

In preferred embodiments of the present invention, the liner is made of vinyl plastic and the cushioning is provided by a number of communicating compartments which are filled with water. These compartments include a top rim cushion that encircles the rim of the bath tub, a bottom rim cushion that encircles the bottom of the bath tub and vertical water filled cushions extending between the top and bottom cushions along the back, side and front walls of the tub. Where the liner includes a bottom portion, the rear part of the bottom portion may be a water filled cushion and the front part is preferably without cushioning and is textured to inhibit slipping when the bather stands in the tub.

It is the principal object of the present invention to provide a light weight, flexible, removeable liner for a bath tub which cushions the bather to enhance both comfort and safety.

It is another object to provide a cushioning liner for a bath tub which is removeable and can be folded into a relatively small package for storing and at the same time provides adequate cushioning inside the tub for the bather's safety and comfort.

It is another object to provide a cushioning liner for a bath tub which does not require any attachment to the tub and which will not float when the tub is filled with water for bathing.

It is a further object to provide a liner for a bath tub which can be brought to the temperature desired by the bather using only water normally available at the spigot of the tub.

It is another object in conjunction with any of the foregoing objects to provide the liner at any desired temperature even before the tub is filled with water for bathing.

These and other features and objects of the present invention are apparent in view of the descriptions herein of specific embodiments of the invention which at present represent the best known uses of the invention and are described in conjunction with the drawings.

DESCRIPTION OF EMBODIMENTS OF THE INVENTION

Figure 1:
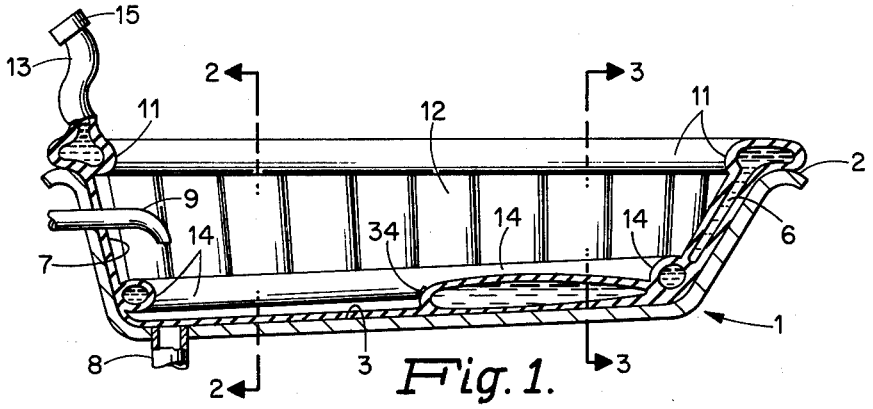
FIG. 1 is a cross section view taken longitudinally through a conventional bath tub in which the liner of the present invention is installed and filled with water and so, ready for filling the tub with water for bathing.

The embodiment of the present invention shown in the FIGS. 1 to 4 incorporates all features of the invention. These figures show the embodiment installed in a more or less conventional bath tub which has a spigot at the front of the tub protruding from the front wall of the tub and a level rim or edge around the top thereof. These features of a bath tub are more or less conventional and so, the liner is designed to accomodate these features and so, have more or less universal use. Another feature of the tub is that the bottom slopes from the back toward the front and the drain is located at the front just below the spigot. This is also a conventional feature of many bath tubs and the liner described is designed to accomodate different depths and slopes of the bottom of the tub, again, to enable use of the liner in a number of different bath tubs. Hence, the cushioning liner described herein includes features which make it useable in a variety of bath tub shapes and sizes. With that in mind, now consider the specific embodiment shown in the figures.

The bath tub 1 includes a top rim 2, an inside bottom 3, left side 4, right side 5, back 6 and front 7. The tub also includes a drain 8 and spigot 9. The top rim 2 is preferably level and the bottom 3 slopes from the back downward toward the front, the drain 8 being located at the bottommost part of the bottom of the tub and the spigot 9 being directly above the drain. Clearly, this is a bath tub of conventional design. The cushioning liner includes a top rim cushion 11 that rests on the top rim 2 of the bath tub and encircles the top rim. This cushion connects with the vertical cushions 12 against the sides, back and front of the bath tub. More particularly, the top ends of all the vertical cushions open into the top rim cushion 11 so that water filling the top rim cushion from the hose attachment 13 flows into the vertical cushions 12. The bottom of the vertical cushions all open into the bottom rim cushion 14 so that it is filled with water as the vertical cushions are filled.

The top rim cushion 11 and the bottom rim cushion 14 may each define a continuous ring, one at the top of the bath tub and the other at the bottom, and the one continuous ring connects to the other through all of the vertical cushions 12. Thus, when the cap 15 on the filling hose 13 is removed and the filling hose is connected to the spigot 9 and the water turned on, the bottom rim cushion 14 will fill first and then the vertical cushions 12 will fill and finally the top rim cushion 11 will fill with water at whatever temperature elected by the bather. This, of course, depends upon the availability of hot and cold water. A drain plug 16 is provided at the bottommost part of the bottom rim cushion 14 for draining water from the cushions 11, 12 and 14.

At the front portion of the cushioning liner, against the front wall of the bath tub, an opening 17 in the liner may be provided to clear the spigot 9. This can be provided by eliminating the vertical cushion at the place of the spigot and substituting the opening 17 instead.

Figure 2:
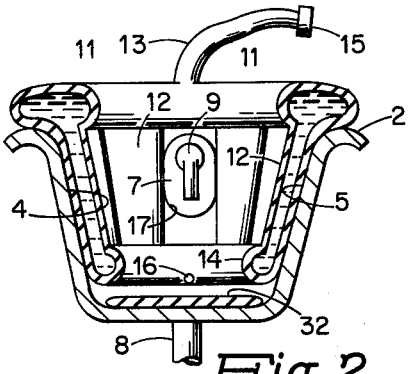
FIG. 2 is a cross section view taken transversely through the tub and liner looking toward the front of the tub.
Figure 3:
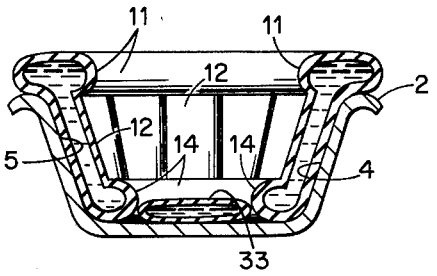
FIG. 3 is a cross section view taken transversely through the tub and liner looking toward the rear of the tub.

Inasmuch as the top rim 2 of the bath tub is level and the bottom 3 slopes toward the front of the tub, the vertical cushions 12 at the front of the liner may be longer than at the back of the liner and so, the bottom rim cushion 14, when installed in the tub and filled with water slopes from the back to the front of the tub, as shown in FIG. 1. In preferred embodiments of the present invention. The bottom rim liner slopes as described to facilitate draining at the plug 16. Clearly, since the bottom rim cushion 14 slopes toward the front of the tub where the tub drain 8 is located, the most convenient location for the cushion drain 16 is as shown in FIGS. 1 and 2, adjacent the tub drain 8. It must be recognized that the depth of bath tubs differ and so does the slope from back to front. Hence, in order to provide a liner for use in many different bath tubs, the length of the vertical cushions 12 should not exceed the depth of the shallowest bath tub. If this is the case, then such a liner installed in an unusually deep bath tub will have the bottom rim cushion 14 located above the bottom of the tub. Thus, however, creates no problem; it only leaves a small part of the tub side walls, along the bottom, without cushioning.

Figure 5:
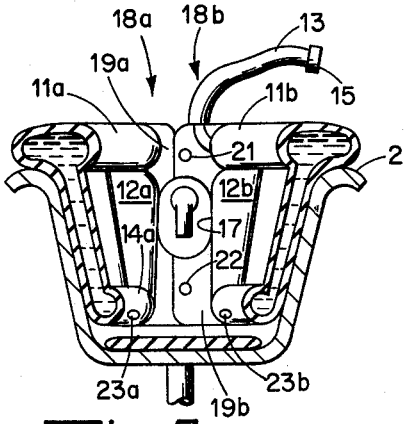
FIGS. 5 and 6 illustrate the construction and use of another embodiment of the liner.
Figure 6:
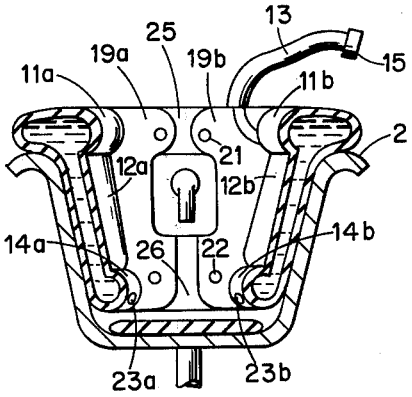

While it is preferred that both the top rim cushion 11 and the bottom rim cushion 14 be continuous rings as described, this, of course, makes the top and bottom perimeters of the liner fixed in dimension and, so, if the tub perimeter dimension is considerably different from the liner, the fit of the liner in the tub can be poor. That is, the perimeter of the liner can be less than the perimeter of the tub or it can be more. If it is less, a portion of the liner will not be against the wall of the tub. If the liner perimeter is greater than the tub perimeter, then a portion of the liner will have to overlap itself. These problems are substantially eliminated with the embodiments of the liner illustrated by FIGS. 5 and 6. In this embodiment, neither the top rim cushion 11 nor the bottom rim cushion 14 is continuous; each has closed ends and the closed ends are located at the front of the tub, as shown in FIGS. 5 and 6. In this embodiment, the liner has two ends, the left end **18*a* and the right end 18*b* which meet at the front of the tub and connect together, leaving the opening 17 for the spigot as shown in FIG. 5. The last vertical cushion 12*a* at the left end connects to the left end 11*a* of the top rim cushion 11 and to the left end of 14*a* of the bottom rim cushion 14 and a connecting flap 19*a* extends from this left end for connection to a similar connecting flap 19*b* that extends from the right end of the cushion. At the right end, the last vertical cushion 12*b* connects to the right end 11*b* of the top cushion 11 and to the right end 14*b* of the bottom cushion 14. The two connecting flaps 19*a* and 19*b* may attach together by connecting snaps 21 and 22 or by any other suitable means. These flaps define an opening 17** to accomodate the spigot.

This embodiment preferably cotains two drains for the liner; one at the end **14*a* and the other at the end 14*b* of the bottom cushion 14. Hence, the two drains 23*a* and 23*b* are provided. At the top cushion liner 11, the filling hose 13 may extend from the left or the right ends. As shown in FIGS. 5 and 6, the filling hose 13 is carried by the right end connecting flap 19*b* and feeds the right end of top liner 11**.

Clearly, where the length of the liner from flap to flap is exactly equal to the perimeter of the bath tub, the liner shown in FIGS. 1 to 4 may fit the tub as well as the liner illustrated in FIGS. 5 and 6. An advantage of making the liner with two ends and connecting flaps is that an extension flap may be provided as required in case the perimeter of the bath tub is greater than the length from flap to flap. Hence, the length of the liner from flap to flap should be selected in view of the smallest bath tub perimeter. Then, the flap extensions 25 and 26 can be used to connect the flaps **19*a* and 19*b* as shown in FIG. 6. These extensions are provided with the liner and may be adjustable. The user adjusts these extensions so that the liner fits the bath tub intended. For example, the extensions could each include several snaps at different positions that mate with the snaps of the end flaps 19*a* and 19*b***. This would permit connecting different lengths of the extensions between the flaps.

Another advantage of the two-ended cushioning liner is that it can be adjusted for different tapers of the walls of the bath tub. For example, where the bath tub walls taper from top to bottom considerably, then the bottom extension 26 would be made shorter than the top extension 25.

Another feature of the present invention which may be included in the embodiment shown in FIGS. 1 to 4 or in the embodiment shown in FIGS. 5 and 6 is the bottom portion of the liner. That portion of the liner is shown in FIGS. 1 to 4. As shown in these figures, the bottom portion 31 of the liner includes a front part which is provided with a non-slip surface 32 and a rear cushion 33. The rear cushion 33 may be a water filled bag, made of the same material as the rest of the liner, and divided into compartments that interconnect. Thus, a cushioned seat is provided that rests on the bottom of the bath tub. This cushion seat is filled with water just as the other cushioning parts of the liner are filled with water. For example, the rear end of cushion 33 connects to the back of the bottom rim cushion 14 and so, filling water flows from that rim into the seat 3. A drain 34 for the seat is provided at the front end of the seat.

Figure 4:
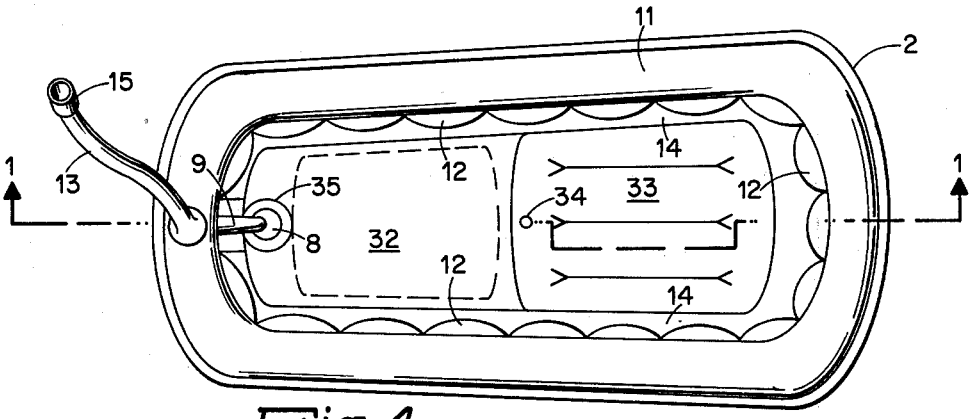
FIG. 4 is a top view of the tub with liner installed and filled with water and ready for filling with water for bathing.

Both the front portion and the seat portion of the bottom of the liner may be connected along their entire perimeter with the bottom rim cushion 14. In that case, the liner truly lines the entire inside of the bath tub and an opening 35 through the front portion of the bottom of the liner is provided in registration with the drain 8 from the bath tub. This construction, shown particularly by FIG. 4, is not readily used with bath tubs of different size. However, it can be made more adaptable if both the front non-slip portion 32 of the bottom of the liner and the seat portion 33 of the bottom of the liner are not connected along their entire perimeters to the bottom rim cushion 14. For example, the seat portion 32 may connect at the back to the bottom rim cushion 14, as described and that may be the only connection of the bottom of the liner to the sides.

The embodiments of the present invention shown in the FIGS. 1 to 6 and modifications of those embodiments which are described in the specification represent the best known uses of the invention and these features and modifications may be used in different combinations without deviating from the spirit and scope of the invention as set forth in the appended claims.

What is claimed is:

1. In a cushioning water filled liner for a bath tub that includes a back cushioning portion provided by back flexible water filled cushions conforming to the back of the bath tub and left and right side cushioning portions provided by left and right side flexible water filled cushions conforming to the left and right sides of the bath tub, means interconnecting said cushions comprising, an elongated top water filled cushion that conforms to the top rim of the bath tub and connects to the back and left and right side water filled cushions, water passages between the top cushion and the top most end of the back and left and right side water filled cushions, a water conducting tube connected at one end to the top cushion and adapted at the other end for connections to the bath tub water spigot by which to fill said cushions with water, the elongated top cushion and the back, left and the right side cushions are fixedly connected together defining an open ended elongated liner and connecting means are provided at the ends of said elongated liner for connecting and disconnecting said ends together so that the liner defines a closed ring fitting the bath tub when said ends are connected and means by which to empty said cushions of water.

2. A cushioning liner for a bath tub as in claim 1 further including, a bottom portion including a bottom flexible water filled cushion conforming to the bottom of the bath tub.

3. A cushioning liner for a bath tub as in claim 1 wherein, the bottom portion covers the front end of the bath tub bottom and the surface of said bottom portion is textured to aid a person standing thereon to avoid slipping.

4. A cushioning liner for a bath tub as in claim 1 wherein water passages are provided between the back and left and right side cushions at the bottom thereof.

5. A cushioning liner for a bath tub as in claim 2 wherein, a drain for the bottom cushion is provided.

6. A cushioning liner for a bath tub as in claim 2 wherein, the bottom portion covers the front end of the bath tub bottom and the surface of the said front bottom portion is textured to aid a person standing thereon to avoid slipping.

7. A cushioning liner for a bath tub as in claim 2 wherein, the inside of the bottom cushion connects to the inside of one of the other cushions.

8. A cushioning liner for a bath tub as in claim 1 further including, a front cushioning portion provided by a front flexible water filled cushion conforming to the front of the bath tub.

9. A cushioning liner for a bath tub as in claim 1 wherein, all portions of the liner connect and form a container of the same general conformation as the bath tub and openings in said container are provided in registration with the bath tub spigot and drain.

10. A cushioning liner for a bath tub as in claim 1 further including, a bottom portion including a bottom water filled cushion conforming to the bottom of the bath tub and a front cushioning portion provided by a front water filled cushion conforming to the front of the bath tub, all water filled portions of the liner connect and the liner forms a container of the same general conformation as the bath tub and openings in said container are provided in registration with the bath tub spigot and drain.

11. A cushioning liner for a bath tub as in claim 1 wherein, the left and right side portions connect to the back portion and means are provided for connecting the left and right side portions at the front of the bath tub.

12. A cushioning liner for a bath tub as in claim 1 wherein, the inside of all water filled cushions interconnect, left and right side drains are provided at the front bottom ends of the left and right side water filled cushions, respectively, and the means connecting said left and right side portions at the front of the bath tub includes left and right side connections which are readily connected together and disconnected to install and remove the liner in the tub.

13. A cushioning lever for a bath tub as in claim 4 wherein, said water passages at the bottoms of the back and left and right side cushions are provided by:

an elongated lower back side water filled cushion that conforms to the lower back and left and right sides of the bath tub and connects to the back and left and right side cushions at the lower ends thereof.

* * * * *